US006682403B1

(12) United States Patent
Laycock

(10) Patent No.: US 6,682,403 B1
(45) Date of Patent: Jan. 27, 2004

(54) GRINDING MACHINE WITH TWO GRINDING WHEELS

(75) Inventor: Michael Laycock, Crosshills (GB)

(73) Assignee: Unova IP CORP, Woodland Hills, CA (US)

( * ) Notice: Subject to any disclaimer, the term of this patent is extended or adjusted under 35 U.S.C. 154(b) by 0 days.

(21) Appl. No.: 10/111,639

(22) PCT Filed: Oct. 26, 2000

(86) PCT No.: PCT/GB00/04130

§ 371 (c)(1),
(2), (4) Date: Apr. 26, 2002

(87) PCT Pub. No.: WO01/30537

PCT Pub. Date: May 3, 2001

(30) Foreign Application Priority Data

Oct. 27, 1999 (GB) ..... 9925367
Oct. 28, 1999 (GB) ..... 9925487

(51) Int. Cl.[7] ..... B24B 1/00; B24B 19/00; B24B 5/42

(52) U.S. Cl. ..... 451/49; 451/9; 451/57; 451/65; 451/119; 451/177; 451/487

(58) Field of Search ..... 451/5, 49, 57, 451/58, 59, 64, 65, 119, 158, 236, 258, 177, 212, 424–426, 487

(56) References Cited

U.S. PATENT DOCUMENTS 3,908,315 A * 9/1975 Schaller ..... 451/242
4,339,895 A * 7/1982 Fivian ..... 451/47
4,584,794 A 4/1986 Hirohata
4,590,573 A * 5/1986 Hahn ..... 700/164
5,613,899 A * 3/1997 Weiss et al. ..... 451/245
5,624,301 A * 4/1997 Lenz et al. ..... 451/47
5,697,831 A 12/1997 Reichel
6,106,373 A * 8/2000 Fabris ..... 451/57
6,331,133 B1 * 12/2001 Katayama et al. ..... 451/9

FOREIGN PATENT DOCUMENTS

EP 0057137 A2 8/1982
GB 2177032 A 1/1987
GB 2271731 A 4/1994
WO WO 1999/032258 A1 7/1999

* cited by examiner

*Primary Examiner*—Joseph J. Hail, III
*Assistant Examiner*—David B. Thomas
(74) *Attorney, Agent, or Firm*—Daniel C. Stelter

(57) ABSTRACT

A grinding machine is disclosed comprising a main frame, a wheelhead, a worktable (16), a headstock (12) and tailstock (14) carried by the worktable (16). A computer is supplied with data indicative of at least one operational parameter of the grinding proces, and the wheelfeed is under the control of signals generated by the computer. Two small diameter grinding wheels (22, 24) are mounted on two parallel spindels mounted on a support member (32) and are independently driven by two motors (28, 30) mounted at the other ends of the spindles. The support member (32) is pivotally joined to the wheelhead. The headstock (12) includes a workpiece drive (20) for rotating the workpiece during a grinding, and its speed of rotation is also controlled by signals generated by the computer. The length of the spindles positions each of the motors (28, 30) axially clear of the tailstock assembly when the wheels (22, 24) are aligned to engaged regions of a workpiece nearest to the headstock (22).

24 Claims, 2 Drawing Sheets

GRINDING MACHINE WITH TWO GRINDING WHEELS

FIELD OF INVENTION

This invention concerns computer controlled grinding machines, especially such machines which are to be used for grinding workpieces requiring small diameter grinding wheels to be employed. By small diameter is meant wheels of 200 mm diameter or less.

BACKGROUND TO INVENTION

It is known to mount more than one grinding wheel on a grinding machine, but by arranging two wheels in accordance with the invention unexpected benefits have been found to follow.

SUMMARY OF THE INVENTION

According to the present invention, a grinding machine comprises a main frame, a grinding wheel support, and a worktable defining a workpiece axis, wherein the wheel support is slidable relative to the mainframe perpendicularly to the workpiece axis, and the worktable is slidable relative to the main frame perpendicularly to the direction of movement of the wheel support; and a computer supplied with data indicative of at least one operational parameter of the grinding process; wherein the wheel support feed is under the control of signals generated by the computer, and wherein (a) a frame is hingably mounted on the wheel support parallel to the workpiece axis, (b) two independently driven small diameter grinding wheels are mounted on the frame remote from the hinged mounting, (c) pivoting of the frame causes the axis of one or the other of the two small wheels to be aligned with the workpiece axis, (d) the worktable includes a headstock including a workpiece drive for rotating the workpiece during grinding, and (e) the pivoting of the frame and the speed of rotation of the workpiece drive are also controlled by signals generated by the computer.

Preferably each grinding wheel is mounted at one end of a spindle which may include one or more hydrostatic bearings and the central shaft of each spindle is directly driven by a motor, at the other end of the spindle.

Where the worktable includes a tailstock preferably the length of each spindle is such as to position the motors axially clear of the tailstock assembly when the wheels are aligned to engage regions of a workpiece nearest to the headstock.

By using relatively small diameter motors and spindles, relatively small diameter wheels can be utilised, which has considerable advantages.

In one arrangement, one of the wheels can be utilised for rough grinding and the other for finish grinding a workpiece, and the wheels are selected accordingly.

A preferred form of this one arrangement is such that the upper grinding wheel is arranged to rough grind, and the lower wheel is arranged to finish grind, the workpieces. In this way the rough grinding process is carried out with the frame in its lowered position, in which the overall assembly of frame, wheelsupport and machine frame is potentially stiffer than when the frame is in its raised condition.

In another arrangement, the wheels are similar and both perform the same grinding function, and one wheel and then the other is used in turn, so that wheel wear is evenly spread between the two wheels, and grinding only has to be interrupted for replacing worn wheels after both wheels have been worn down to an unacceptable level. Since there are two wheels to wear, the time period between machine down times for replacing wheels, is approximately twice the period that would apply if only one wheel were employed.

The hinging of the frame relative to the wheelsupport allows the axis of either of the two grinding wheels to be aligned with the workpiece axis simply by lifting or lowering the frame relative to the wheelsupport.

Pivoting of the frame about its hingable connection to the wheelsupport, may be performed using a pneumatic, hydraulic or electric drive.

Preferably the drive for advancing and retracting the wheelsupport is a linear drive, such as a linear electromagnetic drive, and hydrostatic bearings are provided to support the wheelsupport on a slideway which itself comprises part of the linear drive.

In a preferred embodiment of the invention, a grinding machine comprises a main frame, a grinding wheelsupport, a worktable, a headstock and tailstock carried by the worktable and defining a workpiece axis, wherein the wheelsupport is slidable perpendicularly to the workpiece axis, the tailstock is slidably adjustable relative to the headstock along a slideway carried by the worktable, the latter is slidable relative to the main frame on which a slideway for the wheelsupport is also mounted, and the sliding movement of the worktable relative to the main fame is perpendicular to the direction of movement of the wheelsupport along its slideway, a computer supplied with data indicative of at least one operational parameter of the grinding process, and the wheelfeed is under the control of signals generated by the computer, wherein two independently driven small diameter grinding wheels are mounted on spindles mounted at the outboard end of a frame which is pivotally joined to the wheelsupport, the headstock includes a workpiece drive for rotating the workpiece during grinding, and the speed of rotation of the workpiece drive is also controlled by the signals generated by the computer.

Where the component to be ground is cylindrical, gauging means may be mounted to the grinding machine to enable gauging to be performed, without demounting the workpiece.

Preferably a supply of fluid coolant is provided with means for selectively supplying coolant fluid at an adjustable flow rate, towards the wheel is being employed to grind at the time.

When grinding cylindrical components, uneven wear of grinding wheels, especially CBN wheels, means that sparkout will not necessarily result in a cylindrically true component, and bounce and chatter marks have regularly been found after sparkout is completed. This has been particularly noted when using CBN wheels to grind steel components, such as crankpins of steel crankshafts.

The roundness and surface errors seem to be aggravated when using CBN wheels where separation forces are far higher than for example when using A10x grinding wheels. The stiffness of a CBN wheel is higher than that of an A10x wheel of similar size, and the amount of deflection produced when using a CBN wheel tends to be greater than when using an A10x wheel. These deflections, coupled with the hydrodynamic effect of high pressure coolant, have meant that during sparkout the grinding wheel has tended to bounce into and out of contact with the surface being ground. Chatter marks induced by this bounce seem to be worse when the surface being ground is rotating away from the grinding wheel (ie when the part is not being forced/rotated onto the wheel).

It has been found desirable that u hen grinding workpieces such as crankpins of crankshafts using a two-wheel grinding machine as aforesaid having a computer controlled wheelfeed and workpiece drive in during the grinding of each pin:

(i) the cutting force is maintained on the wheelhead to keep the wheel and pin under a moderate constant load, even during what would have been the sparkout step of known methods, and (ii) during at least a final revolution of the workpiece its rotational speed is reduced;

to prevent bounce and therefore chatter marks appearing in the surface of the pin.

Typically the rotational speed of the headstock drive is reduced to a speed in the range 1 to 5 rpm.

Typically the rotational speed is reduced when the depth of metal left to grind is such that it can be removed during a single revolution of the workpiece at the reduced speed, without exceeding the available power in the wheelspindle drive.

Preferably the pin is gauged before the final grinding step is performed, so as to determine the depth of cut which is necessary to achieve finish size, and the wheelfeed is controlled so as to remove that depth to achieve finish size.

Preferably the coolant rate is reduced during the final single revolution of the workpiece, so that whereas the cutting forces remain constant throughout the final grind revolution, the hydrodynamic forces are reduced.

If any roundness errors on a workpiece (eg crankpin) are still found to exist, a computer based component-profile editing procedure may be employed to remove any such errors where the workpieces are similar, since in general these residual errors will tend to be the same and will appear on each pin on every crankshaft ground, of a batch of similar crankshafts.

Thus in one example of the invention, the majority of the metal to be removed to grind a steel crankpin to size using a CBN wheel, is removable in the traditional manner, and as the pin approaches finish size and only approximately 50 um is left on the radius to be removed, the pin is gauged and the precise oversize determined, the workspeed is decreased to say 3 rpm, the coolant supply is reduced and the wheelhead is controlled so as to remove a final depth increment, the size of which is determined by the gauging from around the pin, during a single revolution of the crankshaft, after which the wheelsupport is retracted so that the wheel disengages completely from the pin, without a sparkout step, leaving the pin ground to size.

It has been found that a wheel can become worn in some places more than others around its circumference. This seems to arise due to any out of balance of the wheel. This imbalance is believed to set up a vibration at a particular frequency, causing spaced apart regions around the wheel to wear more than others, so as to produce what is described as a lobe effect on the grinding wheel. This in turn has been found to be one of the causes of regenerative chatter.

According therefore to another aspect of the invention, in a method of grinding cylindrical workpieces such as crankpins of a crankshaft, particularly when using a CBN wheel, the wheel speed of rotation is varied at intervals during the grinding of the workpieces so as to reduce the uneven wear pattern which can otherwise occur around the grinding surface of the wheel.

According to this aspect of the invention, the wheel speed may be changed after every nth pin has been ground.

Typically n equals 3, but can be any value from 1 upwards. Typically the rotational speed change is of the order of ±2–5% of the nominal wheel speed.

By changing the wheel speed, so the positions of points at which wear can occur as aforesaid will alter so that any extra wear on the grinding wheel will occur at different places around the circumference of the wheel, instead of always in the same places, during each revolution of the wheel.

In any method as aforesaid for grinding cylindrical components such as crankpins of crankshafts, a gauge may be used to measure the component when the latter is expected to be say 100 m above finish size; and a computer supplied with the gauged size is programmed to correct at least the wheel feed to correct for any difference detected by the gauging between the diameter of the pin at the nominal oversize stage and the diameter expected at that point in the grinding.

Although described in relation to the grinding of cylindrical components, a grinding machine having two small diameter grinding wheels as aforesaid may also be used to grind non-cylindrical components such as cams on a camshaft, especially cams having concave regions on their flanks.

In apparatus and methods as aforesaid the two small grinding wheels will normally have the same nominal diameter.

The invention will now be described by way of example, with reference to the accompanying drawings, in which.

Figure 1:
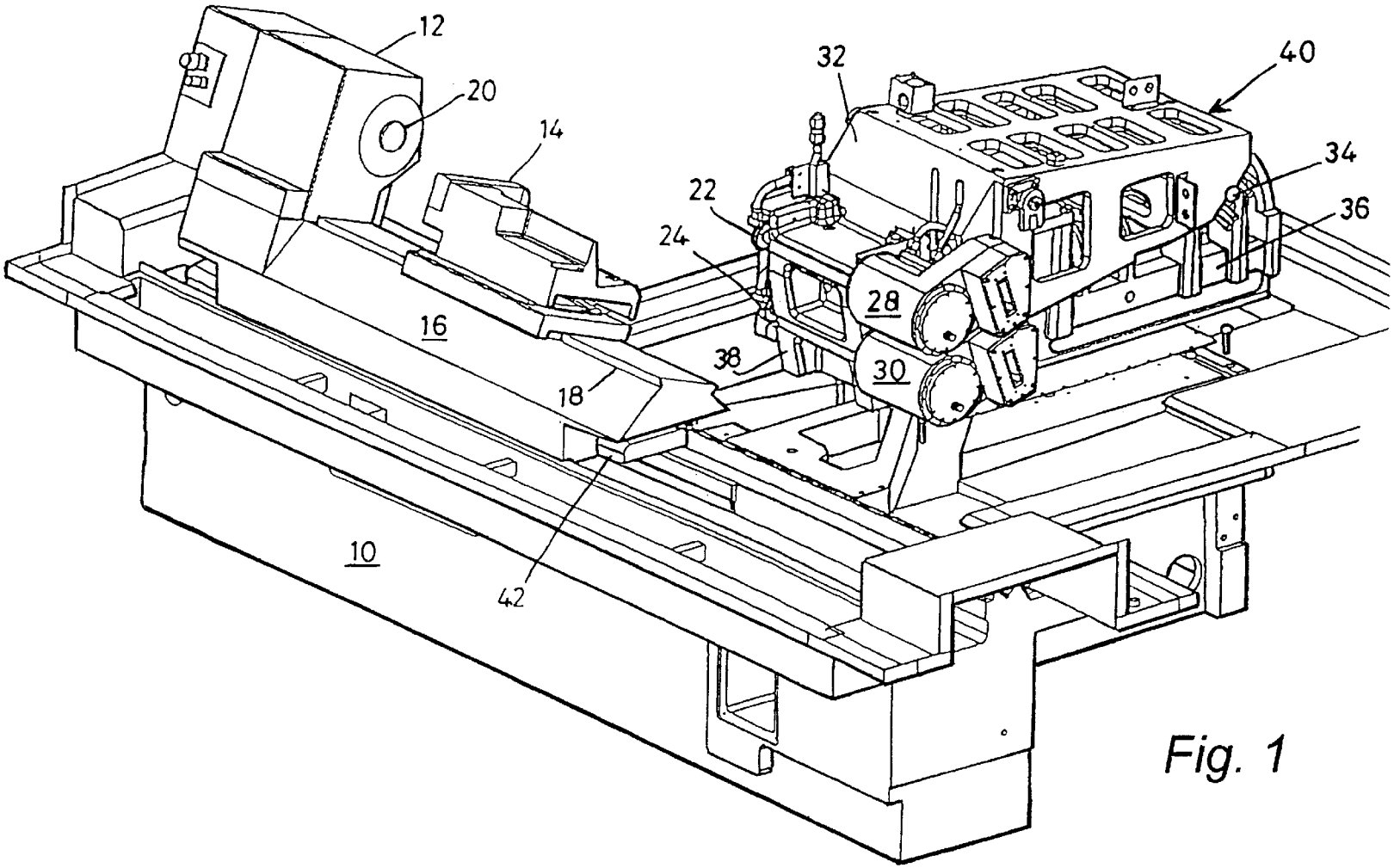
FIG. 1 is a perspective view of a twin wheel grinding machine.

The grinding machine shown in the drawings is intended to grind axially spaced apart regions of a component such as cam lobes on camshafts or crankpins of crankshafts for engines. It will be described in relation to the grinding of pins along a crankshaft.

In the drawings, the bed of the machine is denoted by reference numeral 10, the headstock assembly as 12 and the tailstock 14. The worktable 16 includes a slideway 18 along which the headstock 14 can move and be positioned and fixed therealong.

A rotational drive (not shown) is contained within the housing of the headstock assembly 12 and a drive transmitting and crankshaft mounting device 20 extends from the headstock assembly 12 to both support and rotate the crankshaft. A further crankshaft supporting device (not shown) extends towards the headstock from the tailstock 14.

Two grinding wheels 22 and 24 are carried at the outboard ends of two spindle, neither of which is visible but which extend within a casting 26 from the left hand to the right hand thereof. The spindles are attached to the two electric motors at 28 and 30 respectively, and the latter rotate the central shafts of the spindles and thereby transmit drive to the wheels 22 and 24 mounted thereon, at the other ends of the spindles.

The width of the casting 26 and therefore the length of the spindles is such that the motors 28 and 30 are located well to the right of the region containing the workpiece (not shown) and tailstock 14, so that as the wheelhead and wheels 22 and 24 are advanced to engage crankpins along the length of the crankshaft, so the motors do not interfere with the tailstock.

The casting 26 is an integral part of (or is attached to the forward end of) a larger casting 32 which is pivotally attached by means of a main bearing assembly hidden from view, but one end of which can be seen at 34, so that the casting 32 can pivot up and down relative to the axis of the main bearing 34. It can therefore also pivot relative to a platform 36 which forms the base of the wheelhead assembly and which is slidable orthogonally relative to the workpiece axis along a slideway, the front end of which is visible at 38. This slideway comprises the stationary part of a linear motor (not shown) which preferably includes hydrostatic bearings to enable the massive assembly, generally designated 40 to slide freely and with minimal friction and maximum stiffness therealong.

The slideway 38 is fixed to the main machine frame 10, as is the slideway 42 which extends at right angles thereto, and along which the worktable 16 can slide.

Drive means is provided for moving the worktable relative to the slide 42 (but this is not visible in the drawings).

Typically, the grinding wheels are CBN wheels. 100 mm and 80, diameter wheels have been used. Smaller wheels such as 50 mm wheels could also be used.

Figure 2:
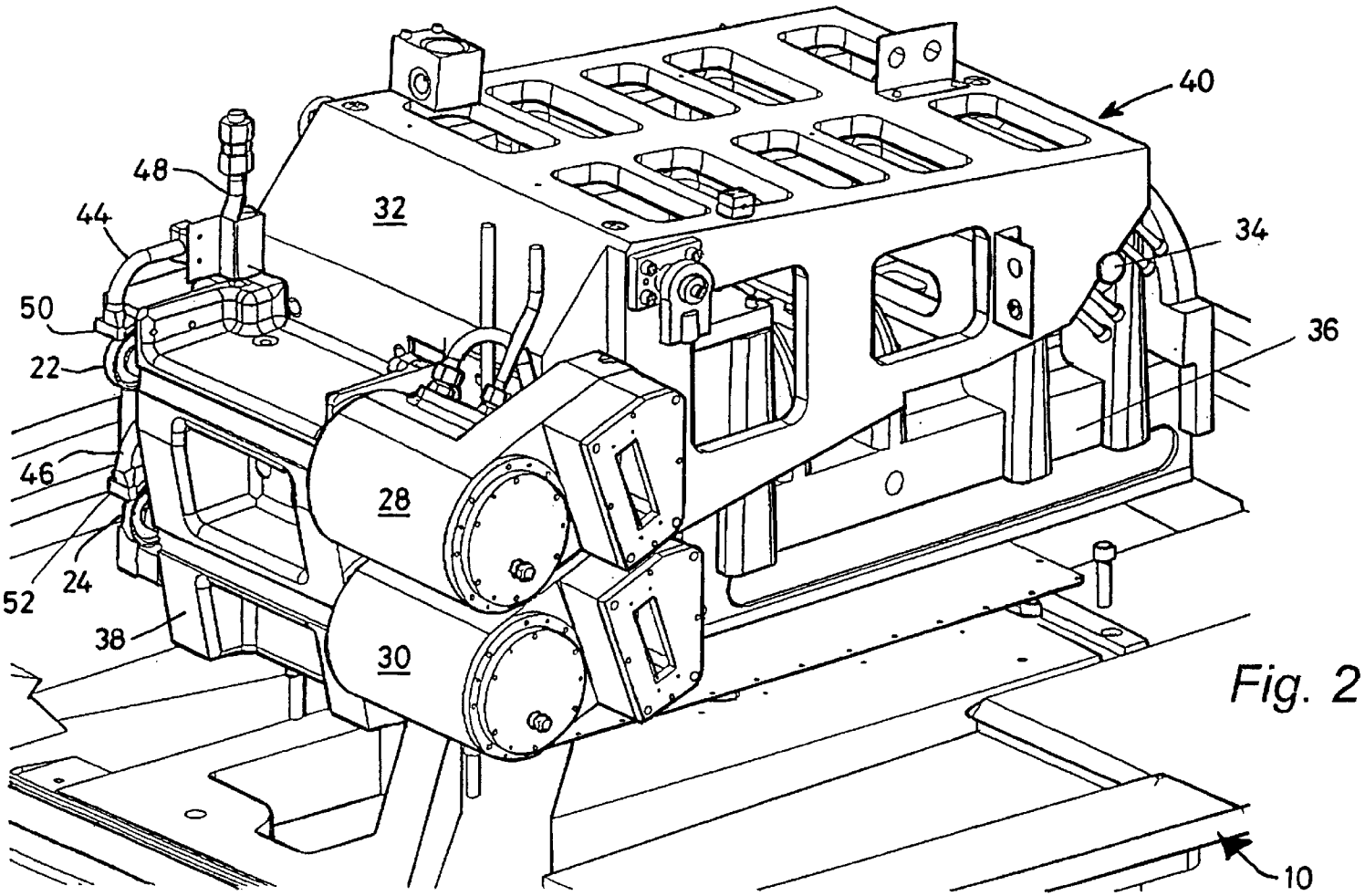
FIG. 2 is an enlarged view of part of the machine shown in FIG. 1.

As better seen in FIG. 2, coolant can be directed onto the grinding region between each wheel and a crankpin, by means of pipework 44 and 46 respectively which extend from a manifold (not shown) supplied with coolant fluid via a pipe 48 from a pump (not shown).

Valves are provided within the manifold (not shown) to direct the coolant fluid either via pipe 44 to coolant outlet 50 or via pipe 46 to coolant outlet 52. The coolant outlet is selected depending on which wheel is being used at the time.

The valve means or the coolant supply pump or both are controlled so as to enable a trickle flow from whichever outlet 50 or 52 is supplying coolant to the wheel performing a final grinding step.

Although not shown, a workpiece gauge can be mounted either on the tailstock or on the slideway 18 between the headstock and tailstock or can be carried by the wheelhead assembly (generally designated 40) so that at a point in the grinding process when the pin can be expected to be for example 100 m size, the pin can be gauged. Depending on the diameter which is gauged, adjustments can be made to the control signals to the linear motor controlling the wheelfeed and/or to the headstock drive motor so as to adjust the depth of cut performed during a final single revolution of the pin so as to remove just the right amount of material to leave the pin at the desired finished size, after the said final single revolution.

A computer (not shown) is associated with the machine shown in FIGS. 1 and 2, and the signals from a gauge (not shown), from a tacho (not shown) associated with the headstock drive, from position sensors associated with the linear motions of the wheelhead assembly and of the worktable, enables the computer to generate the required control signals for controlling the feed rate, rotational speed of the workpiece and position of the worktable and if desired, the rotational speed of the grinding wheels, for the purposes herein described.

What is claimed is:

1. A grinding machine comprising a main frame, a wheelhead and a worktable, defining a workpiece axis, wherein the wheelhead is slidable relative to the mainframe perpendicularly to the workpiece axis, and the worktable is slidable relative to the main frame perpendicularly to the direction of movement of the wheelhead, and a computer supplied with data indicative of at least one operational parameter of the grinding process, wherein the wheelhead feed is under the control of signals generated by the computer, and further comprising:

(a) a frame hingably mounted on the wheelhead parallel to the workpiece axis, (b) two independently driven small diameter grinding wheels are mounted on the frame remote from the hinged mounting, (c) pivoting of the frame causes the axis of one or the other of the two small wheels to be aligned with the workpiece axis, (d) the worktable includes a headstock including a workpiece drive for rotating a workpiece during grinding, and (e) the pivoting of the frame and the speed of rotation of the workpiece driver are also controlled by signals generated by the computer.

2. A machine as claimed in claim 1, wherein each grinding wheel is mounted at one end of a spindle having a central shaft which is directly driven by a motor.

3. A machine as claimed in claim 2, wherein the shaft is supported In hydrostatic bearing means.

4. A machine as claimed in claim 2, in which the worktable carries a tailstock assembly and the length of each spindle is such as to position each of the motors axially clear of the tailstock assembly when the wheels are aligned to engage regions of a workpiece nearest to the headstock.

5. A machine as claimed in claim 1, wherein one of the two wheels is utilised for rough grinding and the other wheel for finish grinding a workpiece, and the wheels are selected accordingly.

6. A machine as claimed in claim 5, wherein the wheels are located one above the other to define upper and lower grinding wheels, and wherein the upper wheel is arranged to rough grind, and the lower wheel is arranged to finish grind, a workpiece so that rough grinding is carried out with the frame in its lowered position.

7. A machine as claimed in claim 1, wherein the wheels are similar and both perform the same grinding function, and one wheel and then the other is used in turn, so that wheel wear is evenly spread between the two wheels, and grinding only has to be interrupted for dressing, or replacing worn wheels, after both wheels have been worn down to an unacceptable level.

8. A machine as claimed in claim 1, wherein the frame is pivotable so that the axis of one or the other of the two grinding wheels is aligned with the workpiece axis, by lifting or lowering the support member relative to a platform forming part of the wheelhead.

9. A machine as claimed in claim 8, wherein the pivoting of the frame is performed using a pneumatic, hydraulic or electric drive.

10. A machine as claimed in claim 1, wherein the drive for the wheelhead is a linear electromagnetic drive.

11. A machine as claimed in claim 10, wherein hydrostatic bearings are provided to support the wheelhead assembly on a slideway which itself comprises part of the linear drive.

12. A machine as claimed in claim 1, for grinding cylindrical components, further comprising gauging means mounted on the grinding machine to enable gauging to be performed, without demounting a workpiece.

13. A machine as claimed in claim 1, wherein a supply of fluid coolant is provided with means for selectively supplying coolant towards one or the other of the two grinding wheels depending on which wheel is being employed to grind at the time.

14. A machine as claimed in claim 13, wherein the coolant fluid flow rate is adjustable.

15. A method of grinding cylindrical workpieces such as crankpins of crankshafts using computer controlled wheelfeed and headstock drives in a two-wheel grinding machine having a headstock drive serving to rotate the workpiece wherein during the grinding of each workpiece:

(i) a cutting force is maintained on a wheelsupport to keep the wheel and workpiece under a moderate constant load; and wherein (ii) a rotational speed of the headstock drive is reduced to prevent bounce and therefore chatter marks appearing in the surface of the workpiece.

16. A method as claimed in claim 15, wherein the reduced rotational speed of the headstock drive is in the range 1 to 5 rpm.

17. A method as claimed in claim 15, wherein during the reduced speed of rotation of the workpiece the wheelfeed is adjusted so as to remove a depth of material during a single rotation of the crankshaft to bring the workpiece to finish size.

18. A method as claimed in claim 17, wherein the workpiece is a crankpin of a crankshaft and the pin is gauged before the final single revolution grinding step is performed, so as to determine the depth of cut which is necessary to achieve finish size, and the wheelfeed is controlled so as to remove the depth that is necessary to achieve finish size.

19. A method as claimed in claim 15, wherein a coolant supply pressure is reduced during the final single revolution of the crankshaft, so that coolant flow rate is reduced during the final revolution.

20. A method as claimed in claim 17, wherein the majority of the metal to be removed to grind a steel crankpin to size using a CBN wheel, is removed in a known manner, and as the pin approaches finish size and only approximately 50 um is left on the radius to be removed, the pin is gauged and the precise oversize determined, a workspeed is decreased to a speed in the range 1–5 rpm, typically 3 rpm, a coolant flow rate is reduced and the wheelfeed is controlled so as to remove during a single revolution of the crankshaft, a final depth increment from the pin, the size of which is determined by the gauging after which the wheelhead is retracted so that the wheel disengages completely from the pin, without a sparkout step, leaving the pin ground to size.

21. A method as claimed in claim 15, when using a CBN wheel to grind crankpins of a crankshaft, the wheel speed of rotation is varied at intervals during the grinding of the pins.

22. A method as claimed in claim 21, wherein the wheel speed is changed after every nth pin has been ground.

23. A method as claimed in claim 22, wherein n equals 3, but can be any value from 1 upwards.

24. A method as claimed in claim 21, wherein the rotational speed change is of the order of ±2–5% of the nominal wheel speed.

* * * * *

UNITED STATES PATENT AND TRADEMARK OFFICE

CERTIFICATE OF CORRECTION

PATENT NO. : 6,682,403 B1
DATED : January 27, 2004
INVENTOR(S) : Michael Laycock It is certified that error appears in the above-identified patent and that said Letters Patent is hereby corrected as shown below:

Title page,
Item [57], ABSTRACT,
Line 5, “proces” should be -- process --

Column 3,
Line 5, “u hen” should be -- when --

Column 4,
Line 12, “100 m” should be -- 100 um --

Column 5,
Line 37, “100 m size” should be -- 100 um oversize --

Column 6,
Line 16, “In” should be -- in --

Signed and Sealed this

Tenth Day of August, 2004

JON W. DUDAS
*Acting Director of the United States Patent and Trademark Office*